United States Patent [19]

Svensson et al.

[11] 3,988,673

[45] Oct. 26, 1976

[54] DEVICE FOR MEASURING THE STOPPING TIME OF WORKING MACHINES

[75] Inventors: Lars-Erik Svensson, Tullinge; Sylvi Rodin, Huddinge, both of Sweden

[73] Assignee: AB Liros Elektronik, Malmo, Sweden

[22] Filed: May 14, 1975

[21] Appl. No.: 577,253

[30] Foreign Application Priority Data

May 15, 1974 Sweden ..... 7406479

[52] U.S. Cl. ..... 324/181; 73/511

[51] Int. Cl.[2] ..... G04F 8/00

[58] Field of Search ..... 324/180, 181; 73/510, 73/511, 526; 100/99

[56] References Cited

UNITED STATES PATENTS

| | | | |
|---|---|---|---|
| 2,591,124 | 4/1952 | Bogan | 324/181 |
| 3,628,142 | 12/1971 | Harris | 324/181 |
| 3,744,424 | 7/1973 | Poppet | 73/511 |

*Primary Examiner*—R. V. Rolinec
*Assistant Examiner*—Michael J. Tokar
*Attorney, Agent, or Firm*—Beveridge, DeGrandi, Kline & Lunsford

[57] ABSTRACT

A device for measuring the stopping time of working machines is provided with first and second switches for synchronically breaking the current to the working machine and starting a time meter, and a third switch for stopping the time meter when the working movement of the working machine has ceased. For the actuation of the first and second switches, the measuring device is provided with a first abutment entrained by the working machine and, in its turn, entraining a second abutment which is provided with its own power source for releasing the second abutment from the first abutment, thereby to actuate the third switch when the working movement of the working machine has ceased.

There is a regulation, with particular regard to presses such as edging presses, eccentric presses and similar working machines, that the press should be provided with information concerning the braking time corresponding to the maximum stopping distance of the press. The stopping time of the press must be predetermined with such accuracy that, in the event of a fault in the press, the stopping time does not increase to an extent which may give rise to accidents. Thus, the safety margin of the press should be such that there is no risk for the operator to be injured during the press movement.

4 Claims, 3 Drawing Figures

DEVICE FOR MEASURING THE STOPPING TIME OF WORKING MACHINES

The present invention relates to a device for measuring the stopping time of working machines; in particular presses such as edging presses and eccentric presses and which comprises a means combined with the press, for example, a runner, which is arranged, in the working cycle of the press, to actuate an abutment by entrainment. Such a per se known device is utilized for measuring the delay between the breaking of the operating current circuit to the machine and the arrival of the machine at rest.

Prior art apparatuses for this purpose are either extremely complicated, and consequently expensive to produce and difficult to apply to a working machine, but which nevertheless provide an acceptable measurement result; or are of simple design and consequently extremely imprecise, providing less accurate results.

Thus, the art stands in great need of an apparatus which combines accurate measurement results with simplicity of manufacture and ease of connection to the working machine, the essential object of the present invention being to satisfy this need.

According to the present invention the problem is solved by means of an electro-mechanical apparatus comprising a first abutment means slidably mounted on a guide, provided with a first contact means and actuated by a runner, the abutment means, on being actuated, indirectly cooperating with a first switching means arranged to break the operating current to the working machine. And with a second switching means which, fully synchronically with the first switching means, breaks the current to a short-circuited time meter, which thus starts a working cycle, and a second abutment means slidably mounted on a guide and provided with a second contact means, the abutment means being arranged to be slidably entrained by the first abutment means, thereby to establish contact between the first and the second contact means, and being also arranged to be driven by its own power source at a speed lower or substantially lower than the speed of the runner at the moment of contact with the first abutment means. Moreover, the first and second contact means serve as a third switch for breaking the contact between the abutment means and thereby the current to the time measurement device, when the working machine and both the runner of the working machine and the first abutment means are arrested and the second abutment means continues, actuated by the power source.

An extremely accurately determined stopping time will be obtained by using an electro-mechanical apparatus designed in accordance with the above. Moreover, the time delays which normally occur in electrical equipment and can give rise to delayed impulses, are eliminated.

The invention will be described in greater detail hereinbelow with reference to the accompanying drawings on which:

Figure 1:
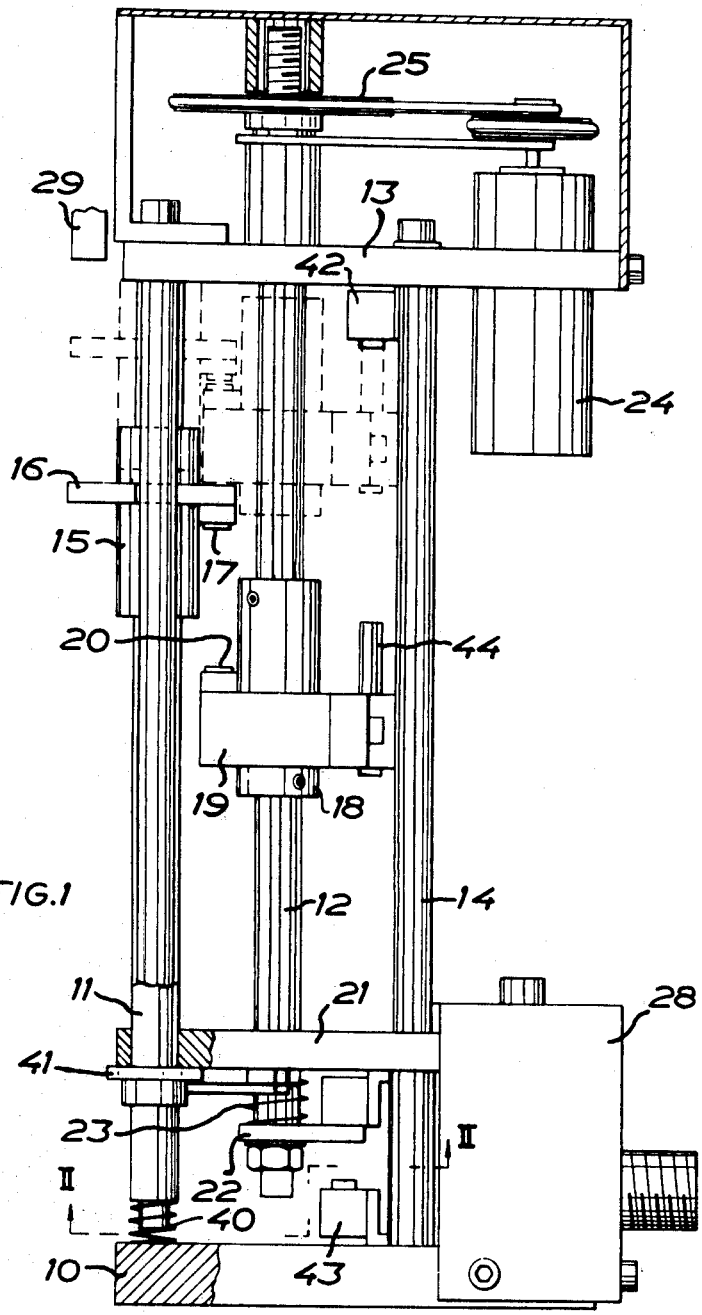
FIG. 1 is a somewhat schematic side elevation, partly in section, of the apparatus according to the present invention.

In FIG. 1, a first vertical guide 11 is passed, with its upper end, through an upper plate 13, and, with its lower end, through a lower plate 21. A second vertical guide 12 is guided through the lower plate 21 and the upper plate 13. A third vertical guide 14 is rather of the character of rigidifying means and forms a support for certain complementary elements. All of the guides 11, 12 and 14 consist of round shafts of a stainless material.

The guide 11 is axially movable a certain determined distance. Its lower portion is formed as a pin and supports a spring 40. An arresting stop 41 abuts against the lower surface of the lower plate 21. A baseplate 10 forms a rigid abutment for the guide 11. Moreover, the guide 11 supports a friction-tight abutment means 15 with an abutment 16 which is dimensioned such that it extends outside the measuring device proper, the intention of this being more clearly apparent below. The lower portion of that part of the abutment 16 which is directed towards the adjacent guide 12 is provided with an electric contact means 17. The guide 12 is axially immobile and provided, in a corresponding manner, with a friction-tight abutment means 18 including an abutment 19, whose portion, directed towards the adjacent guide 11, supports on its upper side an electric contact means 20. The electric contact means 17 an 20, respectively, are located in the same axial plane, that is to say, the one linearly subjacent the other.

The lower portion of the guide 12 is provided with a fixed abutment 22, a spring 23 being interposed between the plate 21 and the upper surface of the abutment 22. Furthermore, the guide 12 is passed through the upper plate 13 and the abutment 18, 19 is powered by its own motor 24 via transmission means 25. A control panel, fixed to the base plate 10 is provided with one or more control knobs and is designated 28.

Two switching means 26 and 27 are disposed at the underside of the lower plate 21 in the same horizontal plane. They are arranged to be actuated by the arresting stop 41 on a downwardly directed movement of the guide 11.

A switch 42 is mounted at the upper end of the guide 14, while a switch 43 is mounted at the lower end of the guide 14, the switches being actuated by a pin 44 fixed mounted on the abutment 18.

Figure 3:
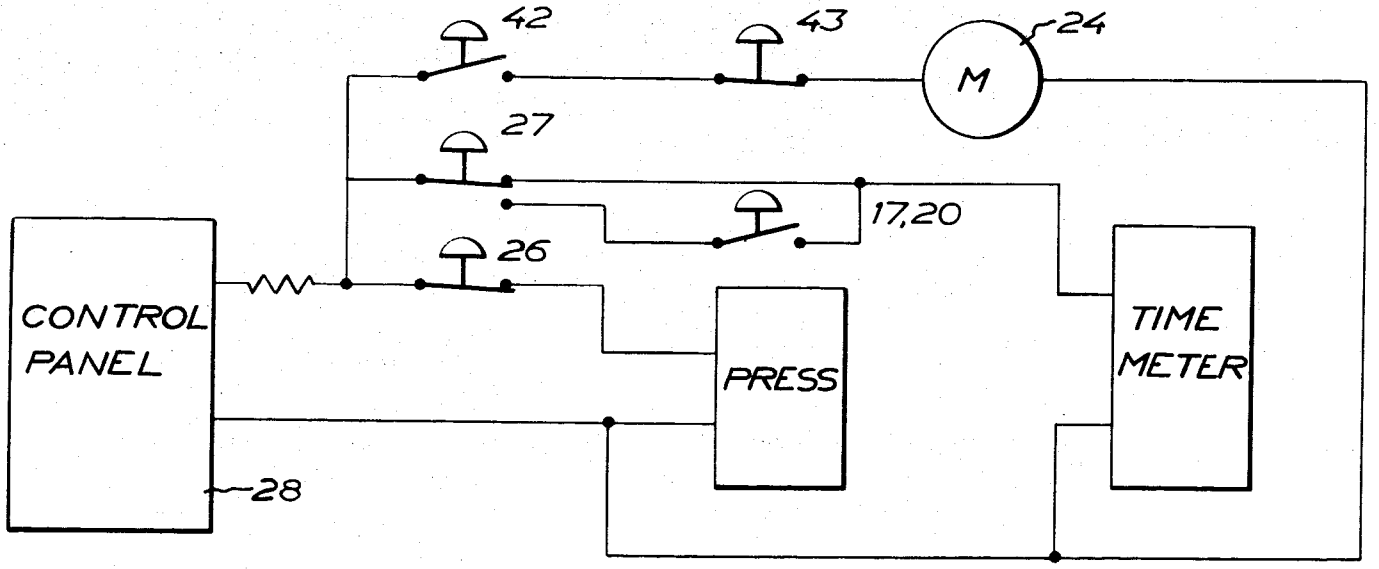
FIG. 3 is a block diagram showing the function of the apparatus.

The electrical connection of the contact means 17, 20, the switching means 26, 27, the switches 42, 43, the motor 24, the control panel 28, a press and a time meter is apparent from FIG. 3.

The electro-mechanical measuring device according to the invention is connected to a press (not shown) for the purposes of very accurate measurement of the current stopping time. A runner on the press is indicated at 29. The abutment means 15 is in an upper position suggested by dash-dot lines and the abutment means 18 is similarly orientated in an upper position, the initial position. At this moment the contact means 17 and 20 are slightly spaced apart and the switch 42 assumes the position shown in FIG. 3 as a result of actuation by the pin 44. On the stroke of the press, the runner 29 actuates the abutment 16 and the abutment means 15 moves downwardly on the guide at a speed substantially equal to the stroke of the press, thus a relatively high speed.

Figure 2:
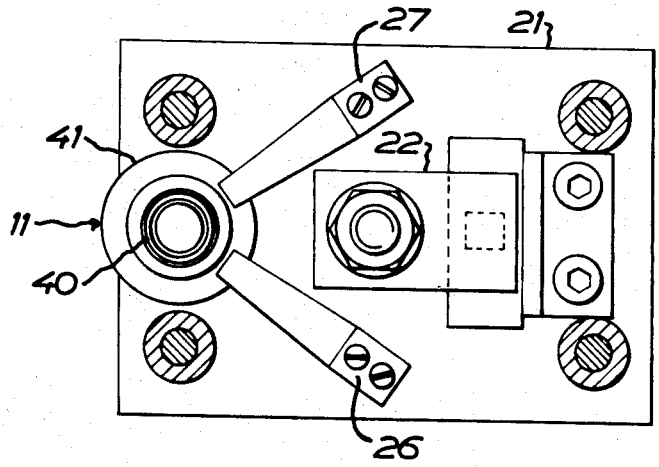
FIG. 2 is a section taken along the line II-II in FIG. 1.

When the runner 29 actuates the friction-tight abutment 15, 16 on the guide 11, this guide 11 will move downwardly and the arresting stop 41 thereby actuates the switching means 26 (FIG. 2) which then breaks the operating current to the press.

Synchronically with the breaking of the operating current to the press, the switching means 27 lying in the same horizontal plane as the switching means 26 is also actuated so that it breaks the current to a short-circuited counter (or time meter). At the same time as (or slightly before) this occurs a circuit between the contact means 17 and 20 is closed in that the abutment means 15, 16, during the downward movement, entrains the abutment means 18, 19. As a result, a starting impulse is imported to the motor 24 for the abutment means 18, 19 and the motor actuates said abutment in a downward direction, with a speed, however, which is slower or substantially slower than the speed with which the runner 29 actuates the abutment means 15. Thus, it is obvious that both of the abutment means move at the same speed for a certain period of time.

When the runner 29 stops and the stroke of the press ceases, there is nothing to actuate the abutment means 15, 16 which consequently also stops. Because the abutment means 18, 19 is driven separately by the motor 24, this abutment means continues its downward movement, which entails that the contact between means 17 and 20 is broken, thereby also breaking the current to the time meter which with great exactitude indicates the stopping time from the point when the operating current to the working machine was broken until the stroke of the press ceased and the machine arrived at a position of rest.

The abutment 18 continues its downward movement until the lower end of the pin 44 strikes the switch 43, thereby breaking the current to the motor 24.

The resetting of the abutment means 15 to the initial position is effected manually. The abutment means 18 is then also manually reset to that position in which the upper portion of the pin 44 actuates the switch 42 and the apparatus is then ready to begin a new working cycle once the time meter has been zeroized.

The operating panel is so designed and connected to the working machine whose stopping time is to be measured, that the working machine may be started via said operating panel. The motor 24 for separate powering of the abutment means 18 is also intended to be started via said operating panel.

Thus, the electro-mechanical arrangement according to the present invention utilizes three breaking functions in order to ensure a precise measurement of the stopping time for each type of press.

What we claim and desire to secure by Letters Patent is:

1. A device for measuring the stopping time of working machines, for example, presses, such as edging presses and eccentric presses and which comprises a means combined with the press, for example, a runner, which is arranged, in the working cycle of the press, to actuate an abutment by entrainment, comprising a first abutment means slidably mounted on a guide, provided with a first contact means and actuated by a runner, the abutment means, on being actuated, indirectly cooperating with a first switching means arranged to break the operating current to the working machine, and with a second switching means which, fully synchronically with the first switching means, breaks the current to the short-circuited time meter, which thus starts a working cycle, and a second abutment means slidably mounted on a guide and provided with a second contact means, the abutment means being arranged to be slidably entrained by the first abutment means, thereby to establish contact between the first and the second contact means, and being also arranged to be driven by its own power source at a speed lower or substantially lower than the speed of the runner at the moment of contact with the first abutment means, the first and second contact means also serving as a third switch for breaking the contact between the abutment means and thereby the current to the time measurement device, when the working machine and both the runner of the working machine and the first abutment means are arrested and the second abutment means continues, actuated by the power source.

2. A device according to claim 1, wherein said abutment means are connected to each respective guide in friction-tight relationship.

3. A device according to claim 1, wherein said first guide displays a limited axial movement, and wherein said runner, at the moment of contact with the first abutment means, forces the guide to move axially, thereby to actuate said first and said second switching means.

4. A device according to claim 3, wherein said first and said second switching means are disposed in the same horizontal plane.

* * * * *

UNITED STATES PATENT OFFICE

CERTIFICATE OF CORRECTION

PATENT NO. : 3,988,673

DATED : October 26, 1976

INVENTOR(S) : LARS-ERIK SVENSSON ET AL

It is certified that error appears in the above-identified patent and that said Letters Patent are hereby corrected as shown below:

In the heading [line 30] under "foreign application priority data" add July 3, 1974 Sweden . . . . . 7406479.

Signed and Sealed this

Twenty-second Day of February 1977

[SEAL]

*Attest:*

RUTH C. MASON
*Attesting Officer*

C. MARSHALL DANN
*Commissioner of Patents and Trademarks*